US007942110B2

(12) United States Patent
Chimienti

(10) Patent No.: US 7,942,110 B2
(45) Date of Patent: May 17, 2011

(54) ELECTROSTATIC COATING DEVICE

(75) Inventor: Francesco Saverio Chimienti, Sesto San Giovanni (IT)

(73) Assignee: Trasmetal S.p.A., Milan (IT)

( * ) Notice: Subject to any disclaimer, the term of this patent is extended or adjusted under 35 U.S.C. 154(b) by 599 days.

(21) Appl. No.: 11/916,298

(22) PCT Filed: May 23, 2006

(86) PCT No.: PCT/EP2006/062541
§ 371 (c)(1),
(2), (4) Date: Dec. 3, 2007

(87) PCT Pub. No.: WO2006/128811
PCT Pub. Date: Dec. 7, 2006

(65) Prior Publication Data

US 2008/0196663 A1 Aug. 21, 2008

(30) Foreign Application Priority Data

Jun. 3, 2005 (IT) ..... BG2005A0034

(51) Int. Cl.
*B05C 19/00* (2006.01)
*B05B 5/025* (2006.01)

(52) U.S. Cl. ..... 118/626; 118/308; 118/629; 118/628; 239/703; 239/706

(58) Field of Classification Search ..... 118/626, 118/621, 623–625, 629, 308, 323, 620; 239/692, 239/700, 701, 703, 706, 223, 224; 427/483, 427/484
See application file for complete search history.

(56) References Cited

U.S. PATENT DOCUMENTS

| | | | | |
|---|---|---|---|---|
| 4,011,991 | A * | 3/1977 | Masuda | 239/708 |
| 4,688,518 | A | 8/1987 | Missier | |
| 4,819,879 | A * | 4/1989 | Sharpless et al. | 239/691 |
| 6,254,684 | B1 * | 7/2001 | Borner et al. | 118/629 |
| 6,874,712 | B2 * | 4/2005 | Milojevic et al. | 239/690 |
| 2004/0149205 | A1 | 8/2004 | Borzone | |

FOREIGN PATENT DOCUMENTS

| | | |
|---|---|---|
| EP | 0 803 292 | 10/1997 |
| EP | 1 481 733 | 12/2004 |

OTHER PUBLICATIONS

International Search Report.

* cited by examiner

*Primary Examiner* — Yewebdar T Tadesse
(74) *Attorney, Agent, or Firm* — Connolly Bove Lodge & Hutz LLP

(57) ABSTRACT

An electrostatic coating device (10) comprising a body defining to an interior chamber (13) communicating with the exterior by means of a first coating powder inlet conduit (14) and a second outlet conduit (15) for said powders, a plurality of electrodes (16) and one or more voltage generators (17) connected to said electrodes (16), wherein said electrodes (16) are positioned so as to generate an electrical field inside said second conduit (15).

19 Claims, 7 Drawing Sheets

ELECTROSTATIC COATING DEVICE

CROSS-REFERENCE TO RELATED APPLICATIONS

This application is a national phase of PCT/EP2006/062541, filed May 23, 2006, which claims priority to BG2005A000034, filed Jun. 3, 2005, the entire contents of all are hereby incorporated by reference.

The present invention refers to an electrostatic coating device, and particularly to an improved electrostatic disk for the powder coating of manufactured items.

In the known art, the coating of metallic items, for example panels or profile shapes, envisages the use of coating chambers, into which the item is introduced and made to pass through, following a specific route around at least one electrostatic disk provided to carry out the coating of the panel.

Normally, the electrostatic disk may be translated long a vertical shaft, the axis of which lies parallel to the vertical axis of the coating chamber. The upwards or downwards translation of the electrostatic disk allows coating of every part of the item, also taking into account the fact that the item may be made to rotate around the disk, in the case where a single disk is used, or to follow a complex route around two or more electrostatic disks, so that both faces are facing towards the edge of the electrostatic disk(s).

The circumference of the electrostatic disk is fitted with a plurality of electrodes, protruding radially from the disk itself, and creating an electrical field, by means of which the coating powder is made to adhere to the panel being coated.

FIG. 1 shows a cross-sectional view of an electrostatic disk of the type known in the art, indicated by reference number 1, which may be translated along a shaft 2. The disk is endowed with a plurality of electrodes 3 protruding radially from the same, and is joined to a base element 4, integral with the shaft 2, with the lower surface of the same and the aforementioned base element 4 defining a chamber 5 which communicates directly with the exterior environment by means of a channel 6 located adjacent to the shaft 2.

The coating powders, with which the piece being processed must be coated, are introduced through the channel 6. Thus, the powder passes into the chamber 5 and, thanks to the presence of pressurised air, is blown towards an aperture 7 opening onto the lower side of the electrodes 3.

The blowing of air, driving the coating powder towards the aperture 7 ensures that the former is made to adhere to the surface of the item being coated, thanks to the presence of an electrical field generated by a voltage generator connected to the upper surface of the electrostatic disk 1.

However, the above described solution has numerous drawbacks. Firstly, the obligatory high voltage of the electrodes and external location of the same, means there is always the possibility of triggering electrical discharges between the electrodes and the piece being coated, as occasionally the latter, as a result of the oscillations caused by its displacement around the electrostatic disk 1, may move too close to the electrostatic disk itself. Thus, said oscillations significantly reduce the coating distance with the consequent triggering of electrical discharges between the electrodes and the item.

At present, safety is guaranteed by a threshold system which limits the maximum current that can pass through the electrode, thus reducing the possibility of triggering discharges.

Each time the current exceeds the maximum set threshold value, the control system limits the supply of energy and, in the most serious cases, can result in the shut-down of the plant.

Another control system known in the art is based on feedback which allows the power to be kept constant, by reducing the voltage with increasing current. However, this control system is not sufficiently rapid to avoid an electrical discharge once this has been triggered.

One of the main problems with the electrostatic disks of the known art, just as with the electrostatic guns and other types of distributors in use, arises from the difficulty coating powders have in penetrating inside cavities or recesses on the surface of the piece being coated. Indeed, a Faraday cage is created within such cavities, thereby limiting, or even impeding entry of the electrostatically charged powder particles inside the cavity itself.

It is known that penetration of powders within the cavities or recesses of the piece being coated is improved by using powders with selected granulometry, smaller than those normally available on the market, and thus requiring special products. This constitutes a cost problem, which is greater the smaller the batches to be coated, and hence less powder required. There are also certain types of powders (the so-called "special powders", including for example the type known as "embossed") the granulometry of which cannot be reduced to the levels capable of resolving the above-mentioned problem for use with the disks of the known art.

The main task of the present invention is that of providing an electrostatic coating device, and particularly an improved electrostatic disk, overcoming the above mentioned drawbacks.

Within the scope of this task, one aim of the present invention is that of providing an electrostatic coating device wherein the powders emitted by the same are endowed with high penetrating capacity Another aim of the present invention is that of providing an electrostatic coating device allowing optimal coating, with uniform thickness and high cover.

A further aim of the present invention is that of providing an electrostatic coating device which does not require the use of coating powders of particular granulometry.

Again, an aim of the present invention is that of providing an electrostatic coating device which eliminates, or at least considerably reduces, the possibility of triggering electrical discharges between the electrodes and the surfaces of the pieces being coated.

Another aim of the present invention is that of providing an electrostatic coating device which overcomes the phenomenon of micro-avalanches of powder inside cavities (a phenomenon generally known by the term "mini-chains").

By no means the final aim of the invention is that of providing an electrostatic coating device, and particularly an improved electrostatic disk, which is highly reliable, relatively simple to manufacture and at a competitive cost.

This task, as well as the other aims, which will be described in full below, are achieved by an electrostatic coating device consisting of a body defining an interior chamber communicating with the exterior by means of a first coating powder inlet conduit, and a second outlet conduit for said powders. The electrostatic coating device according to the invention further comprises a plurality of electrodes and one or more voltage generators connected to said electrodes, and is characterised in that said electrodes are positioned so as to generate an electrical field inside said second conduit.

Indeed, it has been surprisingly observed that appropriate positioning of the electrodes endows the coating powders with greatly higher penetration characteristics in comparison to those obtained with the devices of the known art.

Further characteristics and advantages of the present invention will become apparent from the description of a preferred, but not exclusive, embodiment of an electrostatic coating device according to the invention, and in particular of an electrostatic disk, as shown in the attached drawings, wherein.

The invention will now be described by principally referring to an electrostatic disk, without wishing in any way to limit the scope of application to include devices with different structures or geometries, for example semi-circular or circular sector structures of the type represented in FIGS. 5 and 6, or blade emitters of the type represented in FIG. 7.

Figure 1:
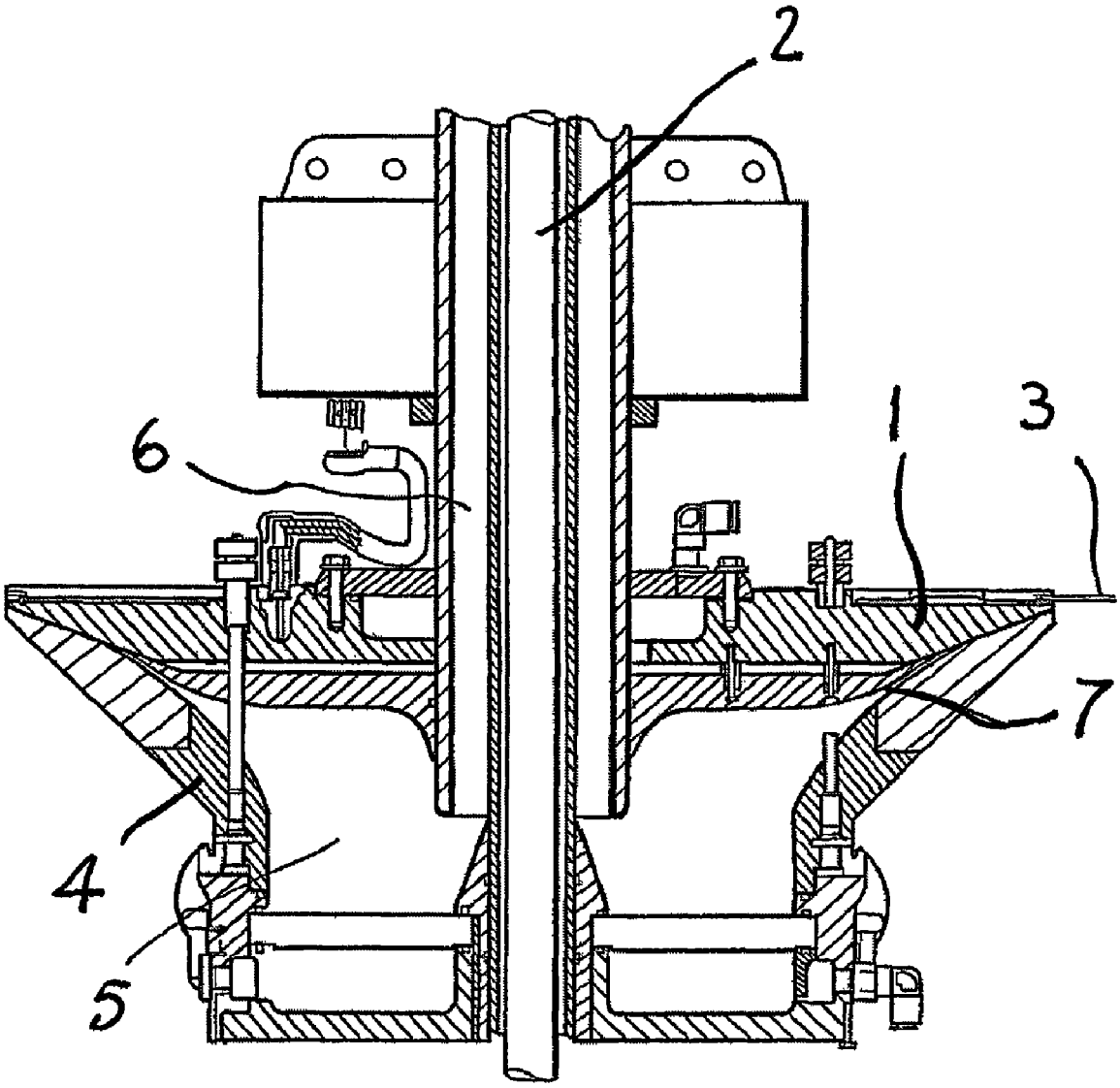
FIG. 1 is a cross-sectional view of an electrostatic disk of the known art.
Figure 2:
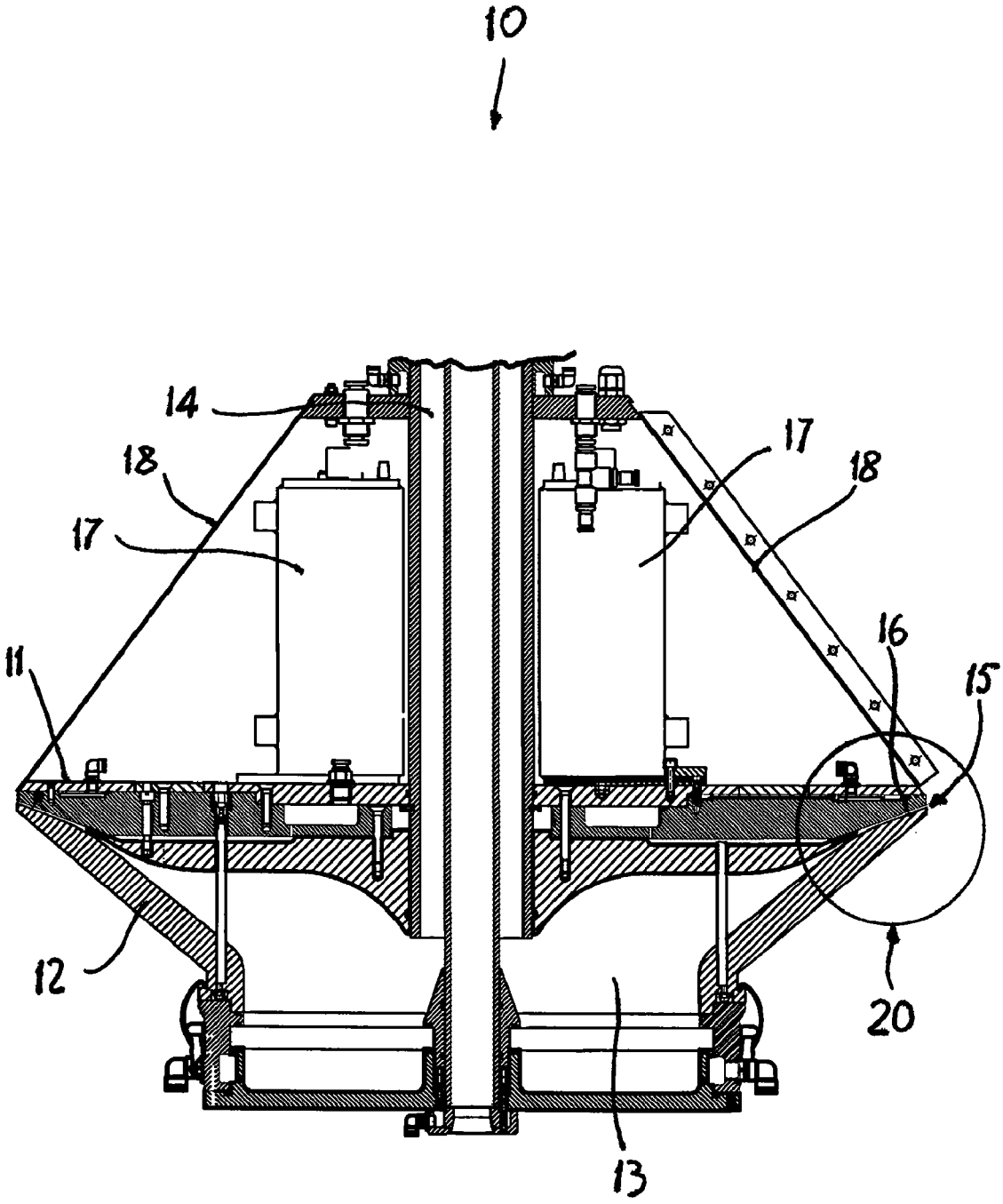
FIG. 2 is a cross-sectional view of a first embodiment of an electrostatic coating device according to the invention, which in this particular embodiment consists of an electrostatic disk.

With reference to the above mentioned figures, wherein identical reference numbers refer to identical components, FIG. 2 shows a cross-sectional view of an embodiment of an electrostatic disk 10 according to the present invention. The electrostatic coating device 10 according to the invention consists of a body defining an interior chamber 13. Said chamber 13 is in communication with the exterior by means of a first conduit 14, into which is introduced the coating powder, and a second conduit 15, from which said powder is discharged with the aid of compressed air.

In order to electrostatically charge the powder coating particles, the device further comprises electrodes 16 and one or more voltage generators 17 connected to said electrodes 16. In the device according to the invention, said electrodes 16 are appropriately positioned so as to generate an electrical field inside said second conduit 15.

Figure 3:
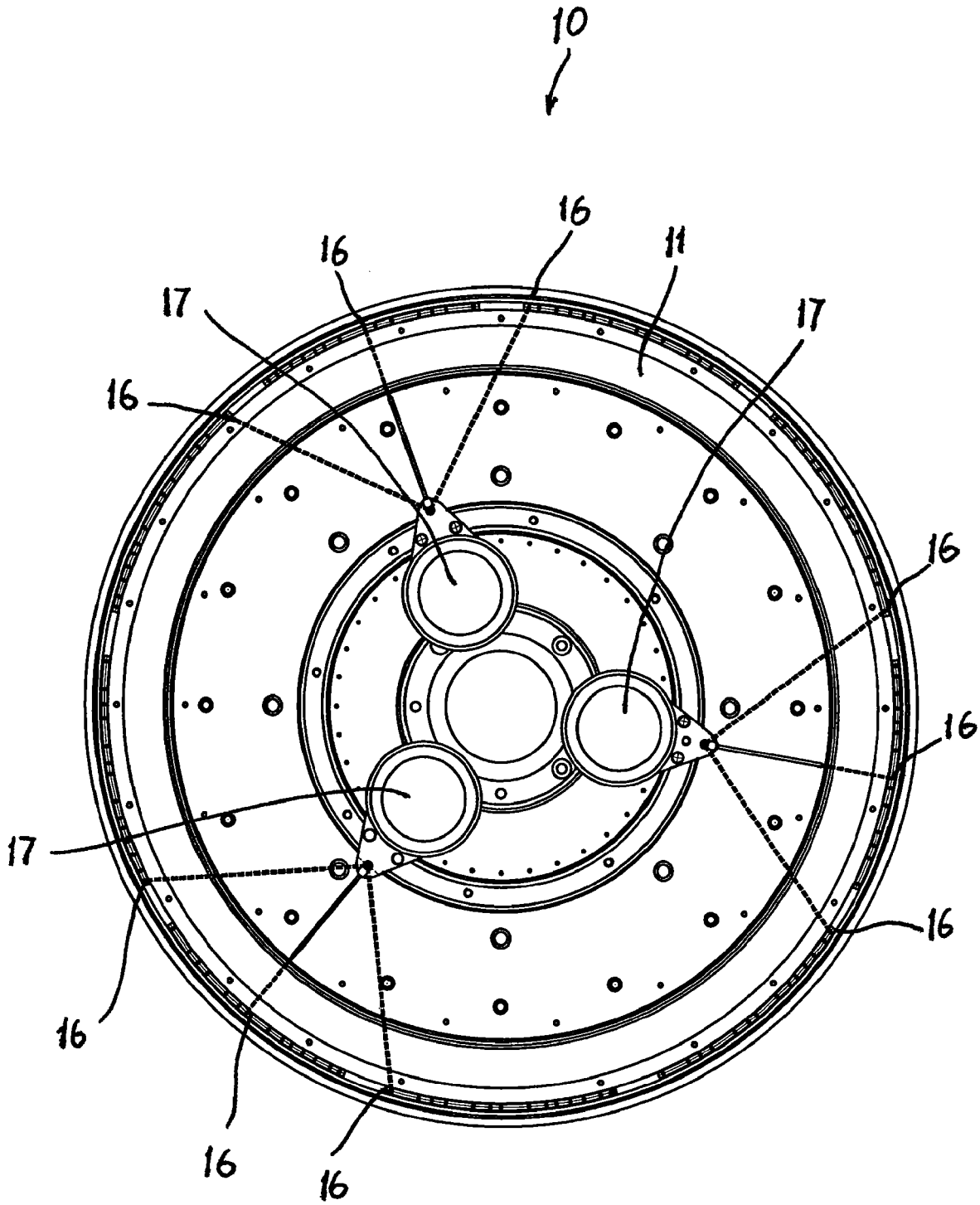
FIG. 3 is a plan view of the electrostatic coating device of FIG. 2.
Figure 4:
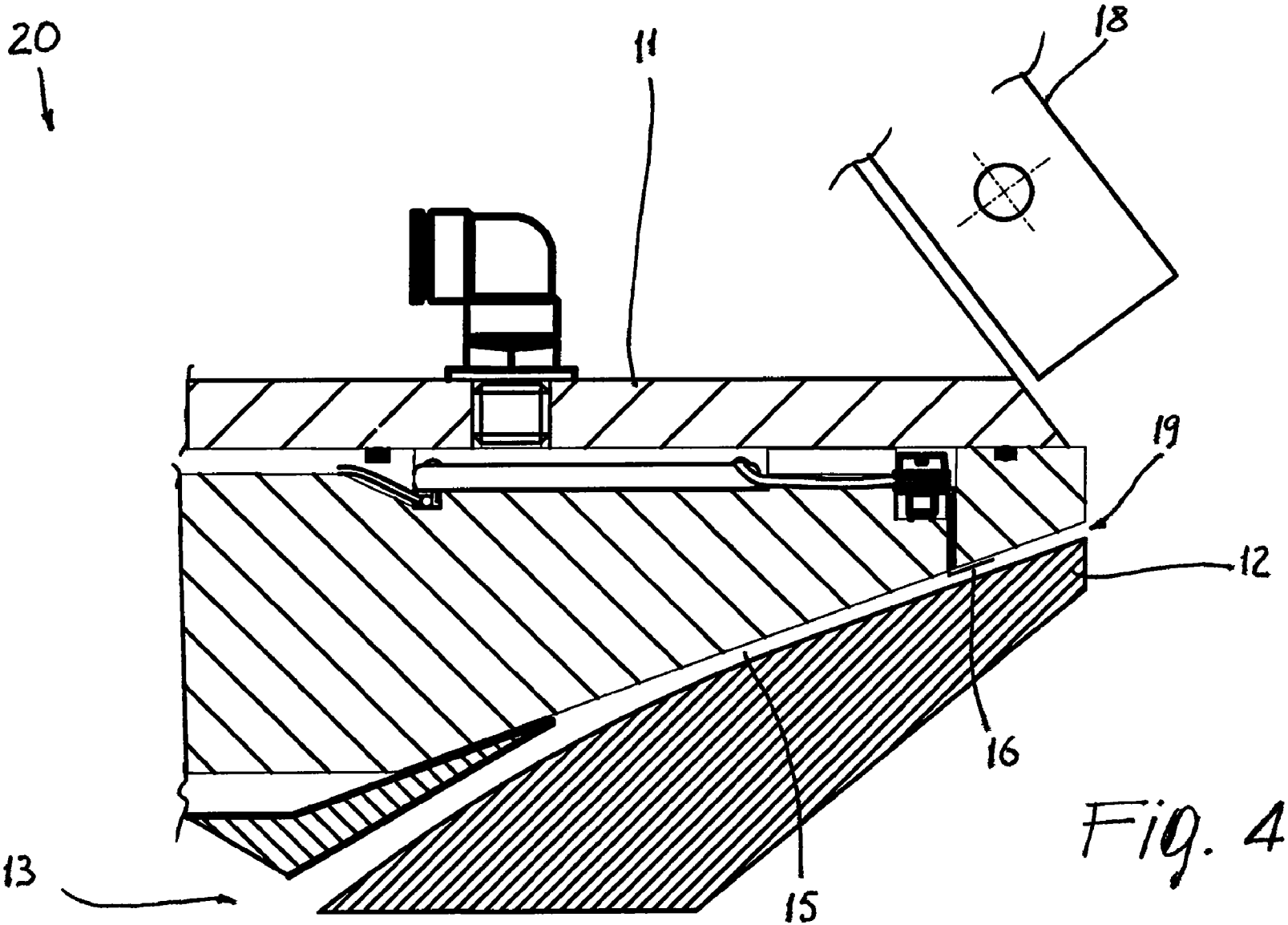
FIG. 4 is a cross-sectional view illustrating a detail of the electrostatic coating device of FIG. 2.

One first embodiment of the invention, shown in FIGS. 2 to 4, envisages the electrodes 16 being appropriately arranged inside said second conduit 15.

Figure 8:
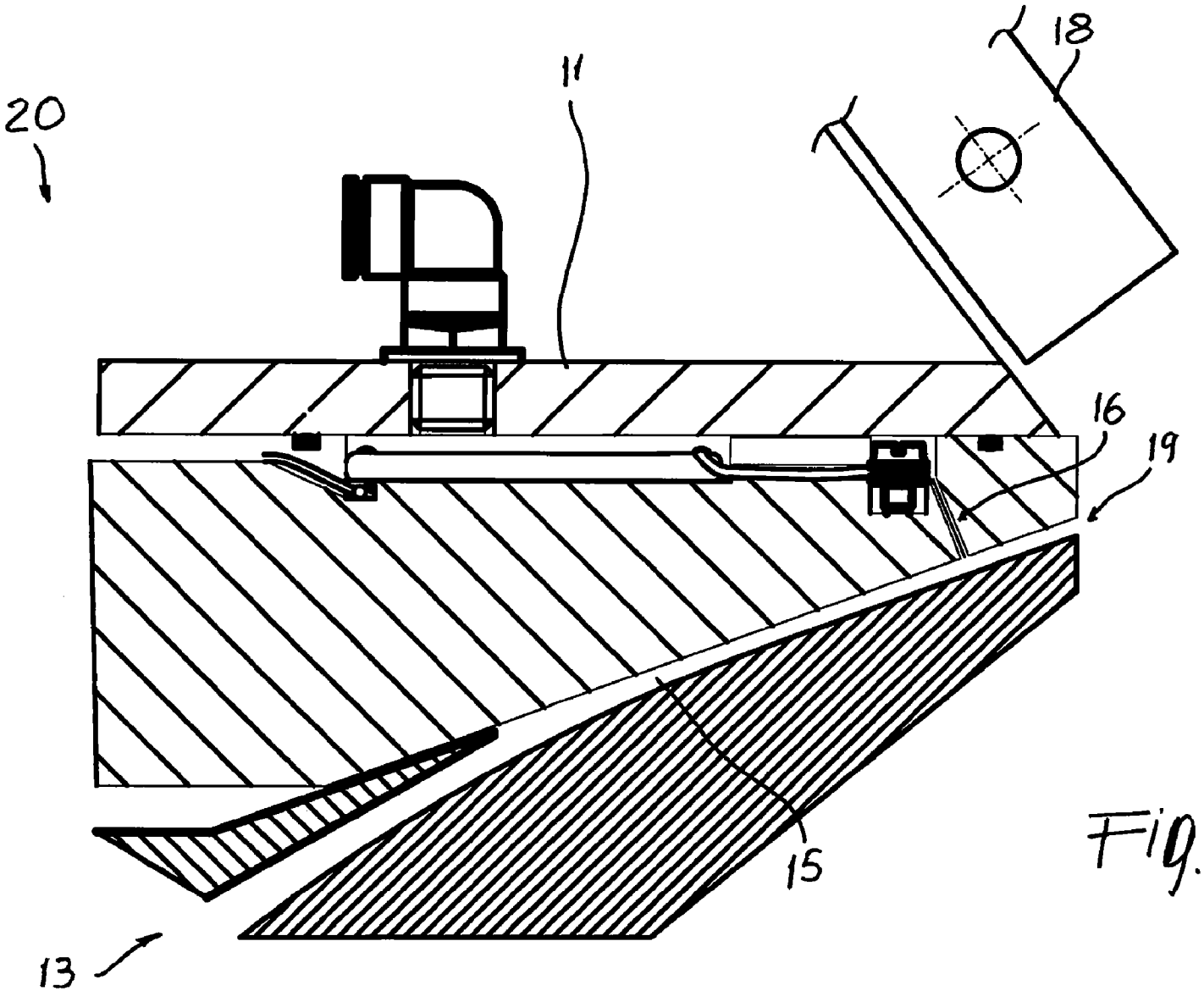
FIG. 8 is a cross-sectional view of a fourth embodiment of an electrostatic coating device according to the invention.

Instead, an alternative embodiment shown in FIG. 8 envisages the electrodes 16 being positioned so as to face onto said second conduit 15.

According to one preferred embodiment of the electrostatic coating device according to the invention, the electrodes 16 are positioned close to the outlet 19 of the second conduit 15. In practice, the electrodes 16 may preferably be positioned at a distance from the outlet 19 of between a few millimetres to several centimetres, both in the case where said electrodes are arranged inside the conduit 15, and in the case where they are facing onto the same.

Preferably, the electrodes 16 are constituted by thread-like elements arranged inside the second conduit 15, or facing onto it, so that the electrical field generated by them intercepts the powder coating particles emerging from the interior chamber 13 through said second conduit 15, immediately prior to reaching the outlet 19.

One particular embodiment of the electrostatic coating device according to the invention envisages the use of a plurality of voltage generators 17, each of which is connected to two or more electrodes 16. This way, it is possible to operate with sufficiently low voltage generator power levels. For example, in the embodiment shown in the enclosed FIGS. 2 and 3, there are three voltage generators, each of which is connected to eighteen electrodes 16.

With reference to FIGS. 2 to 4, the electrostatic coating device 10 is preferably constituted by a body consisting of a disk 11 and an essentially truncated cone shaped base element 14; the disk 11 and the base element 14 are joined to one another so as to form an interior chamber 13 and to define said second conduit 15 in the form of one or more slits positioned between the lower surface of the disk 11 and the upper surface of the base element 14.

Three voltage generators 17 are located at the upper surface of the disk 11, each supplying a plurality of electrodes 16. By way of protection, there is also a closure element constituted by a conical collar 18 located on the upper part of the disk 11.

With reference to FIG. 4, showing an enlarged view of area 20 of the disk of FIG. 2, the disk comprises a plurality of electrodes 16, arranged circumferentially inside the slit forming the second outlet conduit 15. Preferably, the electrodes 16 are constituted by thread-like elements located inside said slit, and arranged radially with respect to the disk 11.

Due to the effect of the compressed air introduced into the chamber 10, the coating powder emerges from said chamber 10 through the slit 15. In close proximity to one of the electrodes 16, the powder particles become electrostatically charged due to the effect of the ionising electrical field generated by said electrode and, once ejected from the slit 15 through the outlet 19, deposit themselves on the item being coated.

One particular embodiment of the device according to the invention is represented in FIG. 8. According to this embodiment, the electrodes 16, of which only one is visible in the figure, are positioned so as to face onto the conduit 15, preferably in close proximity to the outlet 19. In particular, when the electrodes 16 are constituted by thread-like elements, the body of each electrode is contained within the upper part of the device 10, in this case, constituted by a disk 11. The tip of the electrode 16, close to which the electrical field gradients are highest, face onto the conduit 15, optionally protruding inside the same. This way, given the high field values close to the tip, a high capacity of charge transfer onto the powder particles is attained, along with the fact that the electrode body is protected against powder becoming deposited onto it.

As mentioned previously, the device according to the invention may have various shapes and geometrical configurations.

Figure 6:
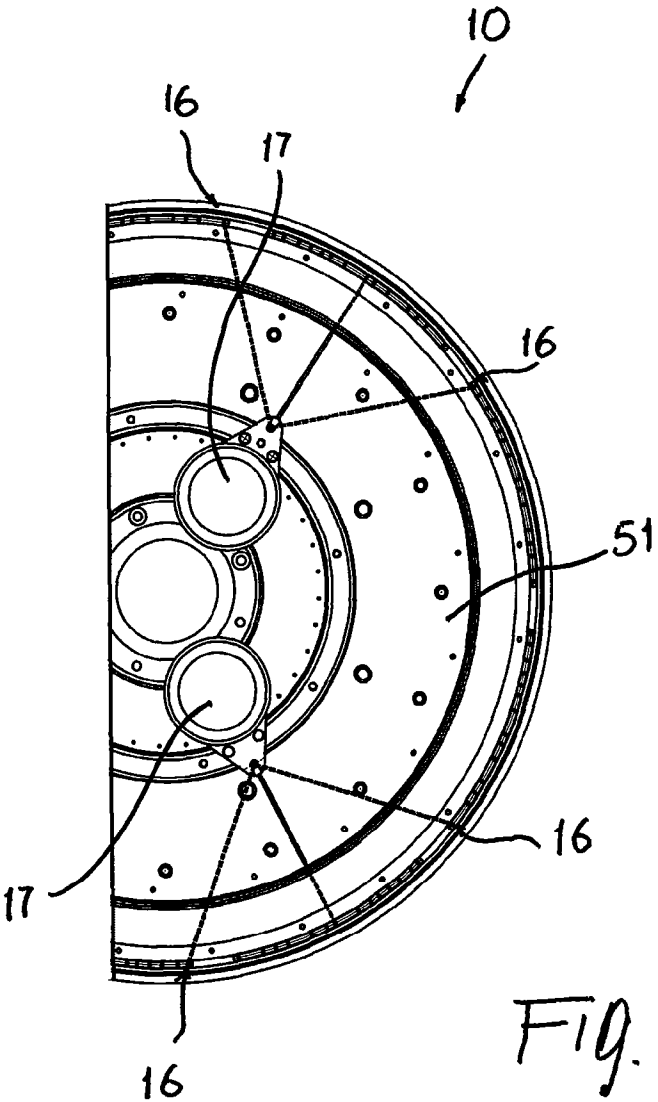
FIG. 6 is a plan view of the electrostatic coating device of FIG. 5.
Figure 5:
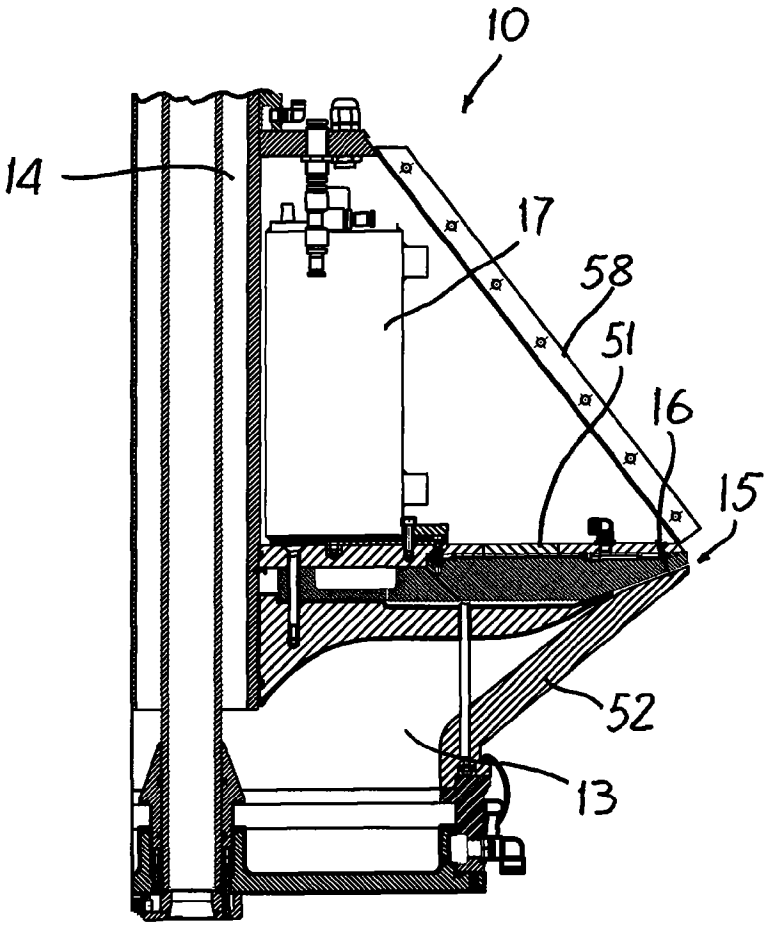
FIG. 5 is a cross-sectional view of a second embodiment of an electrostatic coating device according to the invention.
Figure 7:
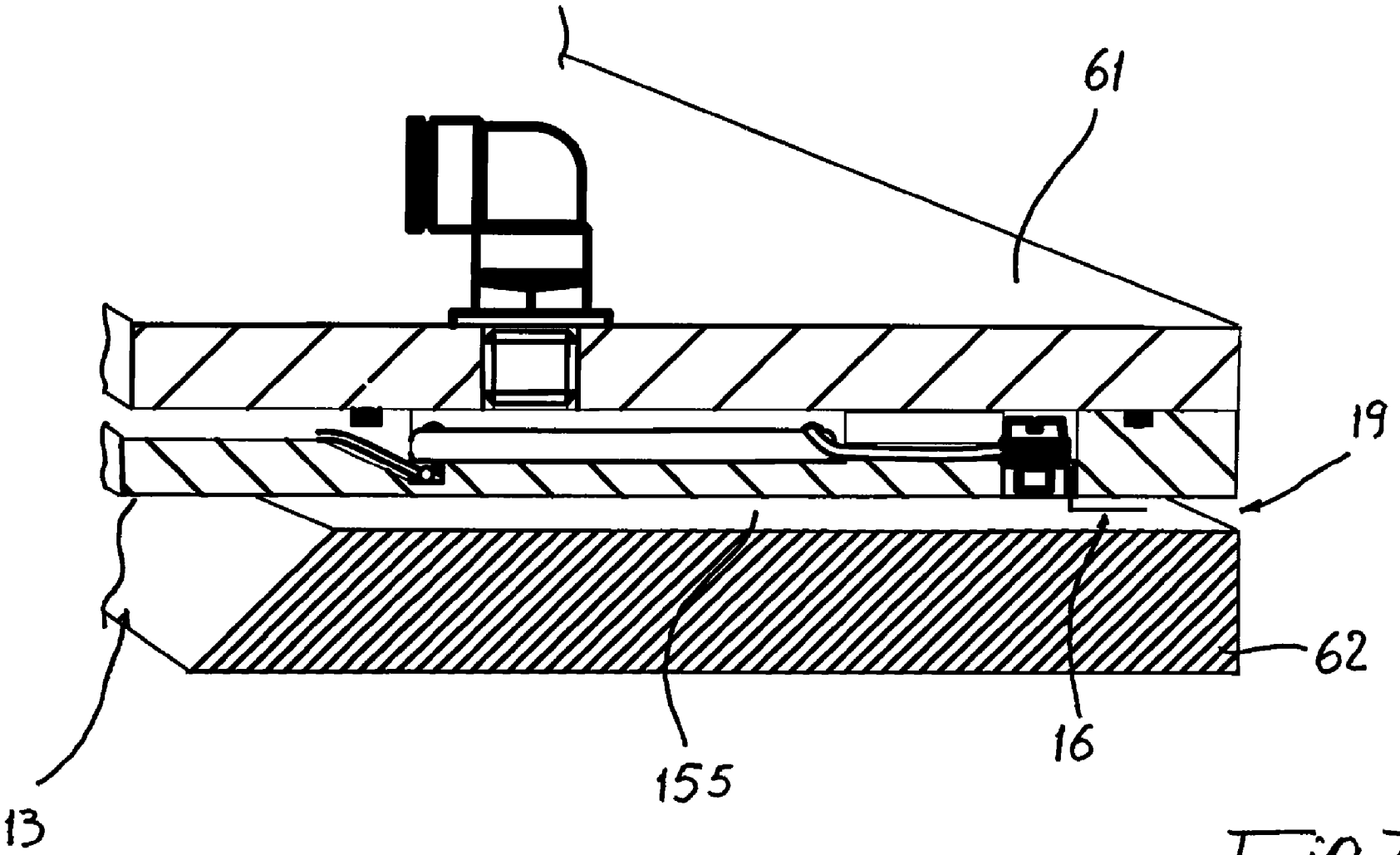
FIG. 7 is a perspective cross-sectional view illustrating a detail of a third embodiment of an electrostatic coating device according to the invention.

For example, with reference to FIGS. 5 and 6, the body 10 of the device according to the invention may be comprised of a circular sector 51 and a base element 52 adapted for joining up with the circular sector 51, so as to form an interior chamber 13 and define the second conduit 15 in the form of one of more slits positioned between the lower surface of the circular sector 51 and the upper surface of the base element 52.

Alternatively, the device according to the invention may have essentially rectangular geometry, with the body 10 having a substantially parallelepiped shape. With reference to FIG. 7, in this case, the body 10 comprises a first upper element 61 and a second lower element 62. Elements 61 and 62 are joined together so as to form an interior chamber 13 and define the second conduit 15 in the form of one or more linear slits 155 located between the lower surface of the first upper element 61 and the upper surface of the second lower element 62. In the embodiment shown in FIG. 7, the electrodes 16 are located inside said slit 155; obviously it is also possible to have a situation similar to that in FIG. 8, wherein the electrodes 16 are positioned so as to face onto, or protrude slightly into, the slit 155.

From field tests, it has been observed that, thanks to the appropriate positioning of the electrodes inside the conduit 15, the device of the present invention even allows the optimal coating of items having complicated surfaces, in that they possess cavities and recesses. Under identical conditions, and without using powders with selected granulometry, such results could not be obtained using the disks of the known art. Independently from the structure of the item, improved uniformity of deposit and greater cover of the powder over the item has additionally been observed, with respect to those obtainable to date.

Furthermore, the device according to the invention allows operating, and obtaining excellent results, even using powders with normal granulometry, i.e. without having to resort to selected, fine granulometry powders.

The coating yield, expressed in terms of powder deposited with respect to the total powder used is very high, with consequently reduced powder recycling, thus resulting in production cost savings.

It has also been observed that, with respect to the disks of the known art, at equal levels of power from the generators 17, with the device of the present invention it is possible to obtain greater levels of charge on the powder, with consequently greater coating yield.

The device according to the present invention may be conveniently applied in powder coating cabins and systems.

Cabins and systems for the powder coating of items comprising an electrostatic coating device according to the above description, constitute a further aspect of the present invention. On the basis of the description given, additional characteristics, modifications and improvements are possible and obvious to those skilled in the art. Such characteristics, modifications and improvements are hence to be considered part of the present invention. In practice, the materials used, as well as the contingent dimensions and shapes may vary, depending on the demands and the state of the art.

The invention claimed is:

1. An electrostatic coating device comprising a body defining an interior chamber communicating with the exterior by means of a first coating powder inlet conduit and a second outlet conduit for said powders, a plurality of electrodes and one or more voltage generators connected to said electrodes, wherein said plurality of electrodes are positioned internally at a distance from the outlet of said second conduit so as to generate an electrical field inside said second outlet conduit, said body comprising a disk and an essentially truncated cone shaped base element joined to one another so as to form said interior chamber and define said second outlet conduit in the form of one or more slits located between the lower surface of said disk and the upper surface of said base element.

2. The electrostatic coating device according to claim 1, wherein said plurality of electrodes are positioned inside said second outlet conduit.

3. The electrostatic coating device according to claim 2, wherein said plurality of electrodes are positioned in close proximity to the outlet of said second outlet conduit.

4. The electrostatic coating device according to claim 2, wherein said plurality of electrodes are constituted by a thread element.

5. The electrostatic coating device according to claim 2, wherein said electrostatic coating device comprises a plurality of voltage generators, each connected to two or more electrodes.

6. The electrostatic coating device according to claim 1, wherein said plurality of electrodes are positioned so as to face into said second outlet conduit.

7. The electrostatic coating device according to claim 6, wherein said plurality of electrodes are positioned in close proximity to the outlet of said second outlet conduit.

8. The electrostatic coating device according to claim 6, wherein said plurality of electrodes are constituted by a thread element.

9. The electrostatic coating device according to claim 6, wherein said electrostatic coating device comprises a plurality of voltage generators, each connected to two or more electrodes.

10. The electrostatic coating device according to claim 1, wherein said plurality of electrodes are positioned in close proximity to the outlet of said second outlet conduit.

11. The electrostatic coating device according to claim 10, wherein said plurality of electrodes are constituted by a thread element.

12. The electrostatic coating device according to claim 10, wherein said electrostatic coating device comprises a plurality of voltage generators, each connected to two or more electrodes.

13. The electrostatic coating device according to claim 1, wherein said plurality of electrodes are constituted by a thread element.

14. The electrostatic coating device according to claim 1, wherein said electrostatic coating device comprises a plurality of voltage generators, each connected to two or more electrodes.

15. The electrostatic coating device according to claim 1, wherein said electrostatic coating device comprises a plurality of voltage generators, each of said voltage generators being connected to one or more electrodes, said plurality of electrodes being arranged circumferentially inside said one or more slits forming said second outlet conduit.

16. The electrostatic coating device according to claim 1, wherein said plurality of electrodes are constituted by thread elements positioned radially inside said one or more slits forming said second outlet conduit.

17. The electrostatic coating device according to claim 1, wherein said body comprises a first upper element and a second lower element, joined together so as to form an interior chamber and define said second outlet conduit in the form of one or more linear slits located between the lower surface of said first upper element and the upper surface of said second lower element.

18. A powder coating cabin comprising an electrostatic coating device according to claim 1.

19. An electrostatic coating device comprising a body defining an interior chamber communicating with the exterior by means of a first coating powder inlet conduit and a second outlet conduit for said powders, a plurality of electrodes and one or more voltage generators connected to said electrodes, wherein said plurality of electrodes are positioned internally at a distance from the outlet of said second conduit so as to generate an electrical field inside said second outlet conduit, said body comprising a circular sector and a base element joining up with said circular sector so as to form said interior chamber and define said second outlet conduit in the form of one or more slits located between the lower surface of said circular sector and the upper surface of said base element.

* * * * *